US011351513B2

(12) United States Patent
Krumbein et al.

(10) Patent No.: US 11,351,513 B2
(45) Date of Patent: Jun. 7, 2022

(54) DEVICE AND METHOD FOR PRODUCING A SOLUTION

(71) Applicant: Sartorius Stedim Biotech GmbH, Goettingen (DE)

(72) Inventors: Franziska Krumbein, Ebergoetzen (DE); Alexander Tappe, Goettingen (DE)

(73) Assignee: Sartorius Stedim Biotech GmbH, Goettingen (DE)

( * ) Notice: Subject to any disclaimer, the term of this patent is extended or adjusted under 35 U.S.C. 154(b) by 666 days.

(21) Appl. No.: 15/755,708

(22) PCT Filed: Aug. 29, 2016

(86) PCT No.: PCT/EP2016/001455
§ 371 (c)(1),
(2) Date: Feb. 27, 2018

(87) PCT Pub. No.: WO2017/036589
PCT Pub. Date: Mar. 9, 2017

(65) Prior Publication Data

US 2019/0022614 A1 Jan. 24, 2019

(30) Foreign Application Priority Data

Sep. 3, 2015 (DE) ..... 10 2015 114 766.1

(51) Int. Cl.
*B01F 15/00* (2006.01)
*B01F 3/08* (2006.01)
(Continued)

(52) U.S. Cl.
CPC ..... *B01F 35/2202* (2022.01); *B01F 23/49* (2022.01); *B01F 23/808* (2022.01);
(Continued)

(58) Field of Classification Search
CPC ..... B01F 15/00285; B01F 15/00318; B01F 5/0602; B01F 35/2202; B01F 35/2207; A61M 2205/6072; A61M 5/16827
See application file for complete search history.

(56) References Cited

U.S. PATENT DOCUMENTS 5,806,519 A * 9/1998 Evans, III ..... A61M 5/007 600/431
2004/0238420 A1 12/2004 Oldendorf et al.
(Continued)

FOREIGN PATENT DOCUMENTS

CN 202199281 4/2012
DE 10 2004 054 172 5/2006
(Continued)

OTHER PUBLICATIONS

Translation of International Preliminary Report on Patentability and Written Opinion for International Application No. PCT/EP2016/001455 dated Mar. 6, 2018.
(Continued)

*Primary Examiner* — Elizabeth Insler
(74) *Attorney, Agent, or Firm* — Gerald E. Hespos; Michael J. Porco; Matthew T. Hespos

(57) ABSTRACT

A device (1) for producing a solution of at least one liquid first medium and at least one second medium has a first container (2) for the first medium and a second container (3) for the second medium. Each container (2, 3) is connected to a supply line of a static mixer (9) via a pump (4, 5) that can be regulated by a controller (6). A sensor (10) is connected to the controller (6) downstream of the static mixer (9) in the flow direction. A branching valve (17) is downstream of the static mixer (9) in the flow direction and is controlled by the controller (6). A sterile filter (11) is downstream of the static mixer (9) and has an RFID tag (15)
(Continued)

that stores process-relevant data to at least be read by the controller (6). A method also is provided for producing a solution using the device.

13 Claims, 7 Drawing Sheets

(51) Int. Cl.

| | |
|---|---|
| ***B01F 3/22*** | (2006.01) |
| ***B01F 5/06*** | (2006.01) |
| ***B01F 35/22*** | (2022.01) |
| ***B01F 23/40*** | (2022.01) |
| ***B01F 23/80*** | (2022.01) |
| ***B01F 25/42*** | (2022.01) |
| ***B01F 35/21*** | (2022.01) |

(52) U.S. Cl.
CPC ..... *B01F 25/42* (2022.01); *B01F 35/2132* (2022.01); *B01F 35/2133* (2022.01); *B01F 35/2207* (2022.01)

(56) References Cited

U.S. PATENT DOCUMENTS

| | | | | |
|---|---|---|---|---|
| 2008/0060983 | A1* | 3/2008 | Kleber ..... | B01D 35/143 210/85 |
| 2010/0312174 | A1 | 12/2010 | Hoffman | |
| 2013/0068673 | A1 | 3/2013 | Maggiore et al. | |

FOREIGN PATENT DOCUMENTS

| | | |
|---|---|---|
| DE | 101 65 007 | 8/2009 |
| EP | 0 650 739 | 5/1995 |
| EP | 1 479 428 | 11/2004 |
| EP | 2 682 168 | 1/2014 |
| JP | 2013-71034 | 4/2013 |
| WO | 2014/121157 | 8/2014 |

OTHER PUBLICATIONS

International Search Report dated Dec. 13, 2016.
Management Theories and Practices of Hospital Disinfection Supply Centers.

* cited by examiner

DEVICE AND METHOD FOR PRODUCING A SOLUTION

BACKGROUND

Field of the Invention

The present invention refers to a device for producing a solution of at least one liquid first medium and at least one additional second medium. The device includes a first container for the liquid first medium and a second container for the second medium. Each container is connected to a supply line of a static mixer via a pump that can be regulated by a process controller. A sensor device is connected to the process controller and is arranged downstream of the static mixer in the flow direction. A branching valve is arranged downstream of the static mixer in the flow direction and can likewise be controlled by the process controller.

The invention also refers to a method for producing a solution of at least one liquid first medium and at least one additional second medium.

Description of the Related Art

Static mixers are normally conduits or channels with fixed installations, which, by using the flow energy, cause a mixing of fluid product flows. With respect to mixers with movable stirring elements, static mixers often have a smaller chamber volume and a very low energy consumption. Static mixers are closed systems that do not require either maintenance or inertizing. The scale-up risk in static mixers is very low due to the strictly defined geometry and flow direction.

In current industrial application, static mixers are used in various ways. Moreover, the range of application of static mixers is very large, for example: mixing of pumpable liquids, dispersing and emulsifying of mutually insoluble components. For example, static mixing technology can be applied to: mixing and homogenizing of plastic molten masses, gas/liquid and liquid/liquid contacting, material transfer, heat transfer and chemical reactions.

JP 2013/071034 A1 discloses a device and a method for producing a solution of a first liquid medium and a second medium. A first container for the first liquid medium and a second container for the second medium are connected via a pump that is controlled by a process controller, to a supply line of a static mixer. The static mixer is connected to a sensor device for density measurement. The sensor device is positioned downstream with respect to the flow direction and is connected to the process control. A branching valve controlled by the process controller is positioned downstream of the sensor device, in the direction of flow.

A drawback is that the production of a sterile solution having a defined composition from at least two different mediums cannot be ensured sufficiently.

Moreover, DE 101 65 007 B4 discloses a filtration device that has filters with RFID-tags for improving the safety of the filtration process.

The object of the present invention is to provide a device and a method, with which a sterile solution having a defined composition is highly likely to be produced from at least two different mediums.

SUMMARY

The invention relates to a device for producing a solution of at least one liquid first medium and at least one additional second medium. The device has a first container for the liquid first medium and a second container for the second medium. Each container is connected to a supply line of a static mixer via a pump that can be regulated by a process controller. A sensor device is connected to the process controller and is arranged downstream of the static mixer in the flow direction. A branching valve is arranged downstream of the static mixer in the flow direction and can likewise be controlled by the process controller. A sterile filter is arranged downstream of the static mixer in the flow direction. The sterile filter has an RFID tag and the RFID tag stores process-relevant data which can at least be read by the process controller.

The arrangement of the sterile filter downstream of the static mixer, in the flow direction, ensures that the produced solution is a sterile solution. The RFID tag of the sterile filter stores process-relevant data, that can at least be read by the process controller. As a result, the user may perform a process control in advance thus avoiding wrong installations. Process-relevant data are to be construed as data that refer to the identity of the filter, to the release status, the compatibility with buffer solutions and test data.

The arrangement of the sensor device downstream of the static mixer, in the direction of flow, and the connection of the sensor device to the process controller enables the set mixing ratio to be verified and regulated by controlling the pumps. The branching valve may be controlled by the process controller. Thus, in the case of a mixing ratio exceeding a threshold value, the branching valve may be opened and the solution to be discarded may be discharged.

According to a further embodiment of the invention, a third container for a third medium may be connected to the supply line of the static mixer via a pump that can be regulated by the process controller. Thus, the admixing of a third solution component to the mixing solution may be performed in a relatively easy and secure way. In order to improve the control over the mixing ratio, the sensor device may be expanded by a further parameter to be measured.

The containers also may have one respective RFID tag that may be at least read by the process controller, and in which further process-relevant data may be stored. Thus, a process monitoring performed in advance has an improved reliability. In particular it is possible to identify the containers and to check their contents with regards to compatibility and release, so that wrong installations may be avoided.

The sensor device may be arranged between the static mixer and the sterile filter. The controllable branching valve may then be positioned between the sensor device and the sterile filter. If the sensor device is positioned downstream of the sterile filter in the direction of flow, the controllable branching valve also is positioned downstream of the sensor device.

The branching valve may be connected to a branching line for branching out the solution of insufficient quality. Fundamentally the controllable branching valve has always to be arranged downstream of the sensor device, in order to ensure checking before the branching valve. The branching line may be connected in this case to a return line to the first container via a second controllable branching valve. In case of corresponding correction of the components to be supplied it is possible to produce the required mixing ratio in a corrective process.

The static mixer, the sensor device and the sterile filter with the RFID tag may form a prepackaged mixing system, the attachments of which are adapted for connection to the containers or to the pumps that are associated to the containers, as sterile connectors, which are known to the person skilled in the art. Thus, it is possible to use the prepackaged mixing system as a disposable system for continuous production of process mediums, in particular for chromatography, crossflow-filtration, fermentation and cell cultivation. Due to the use of disposable technologies (also for the containers to be connected, so called disposable bags), complex cleaning steps and the corresponding validation as well as the resulting high acquisition costs may be avoided for the user. Moreover, due to the omission of rigid stainless-steel components, the production space design may be rendered more flexible. Due to sterile processing, the contamination risk by high packaged sterilized mixing systems is reduced.

The invention also relates to a method that may use the above-described device for performing the following steps:

a) reading and checking the process-relevant data of the data stored in the RFID tag(s) by the process controller, b) releasing and starting the mixing process, c) monitoring the mixture parameters using the sensor device and regulating the mixture ratio using the process controller via the pumps, d) releasing the solution in the event of a sufficient quality, or e) discharging the solution into a branching line via the branching valve if the quality is insufficient.

With the inventive method, it is highly likely possible to produce a sterile end fluid with a defined composition, as a solution, from at least two different liquids. In particular, the inventive method has the characteristics and advantages already described in the case of the device.

In case of insufficient quality of solution, the method may further include a step f) of returning the solution from the branching line via a return line to the first container for the liquid first medium. In this way, it is still possible to restore the desired quality for the already discharged solution. Fundamentally it is also possible to return the solution from the branching line via a return line to an additional container that also is connected to the prepackaged mixing system.

Further characteristics and advantages of the invention are obtained from the following specific description and from the drawings.

DETAILED DESCRIPTION

Figure 1:
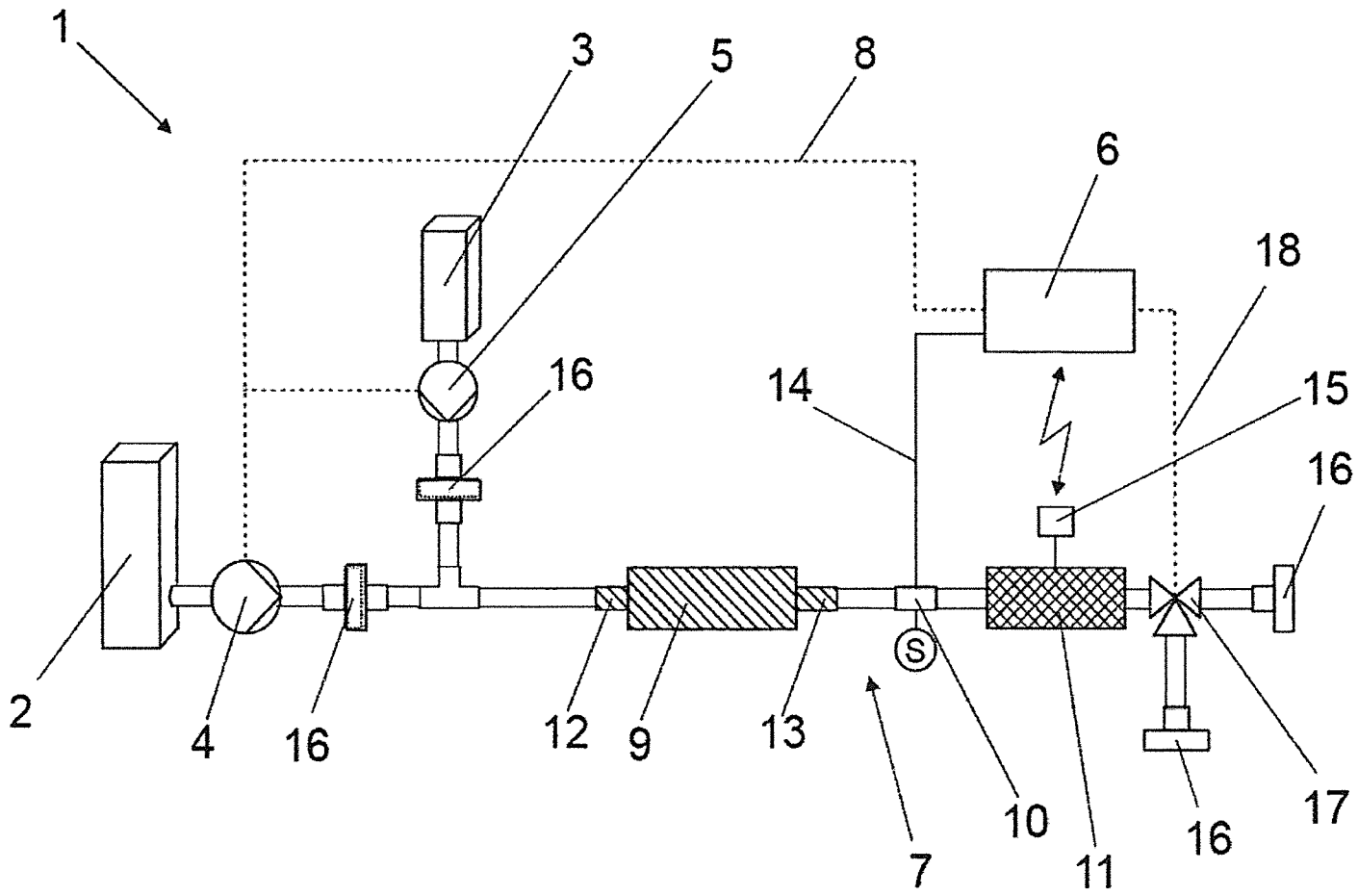
FIG. 1 shows a schematic representation of a device with a first and second container and a sensor device, which is positioned between a static mixer and a sterile filter.

A device 1 for producing a solution of at least one liquid first medium and at least a further second medium is essentially composed of a first container 2, a second container 3, a first pump 4, a second pump 5, a process controller 6 and a prepackaged mixing system 7.

The first container 2 is filled with a liquid first medium, and is connected to the first pump 4 that is positioned upstream in the direction of flow. Correspondingly, the second container 3 is connected to the second pump 5 that is positioned upstream in the direction of flow. The pumps 4, 5 are connected to the process controller 6 via control lines 8.

Figure 7:
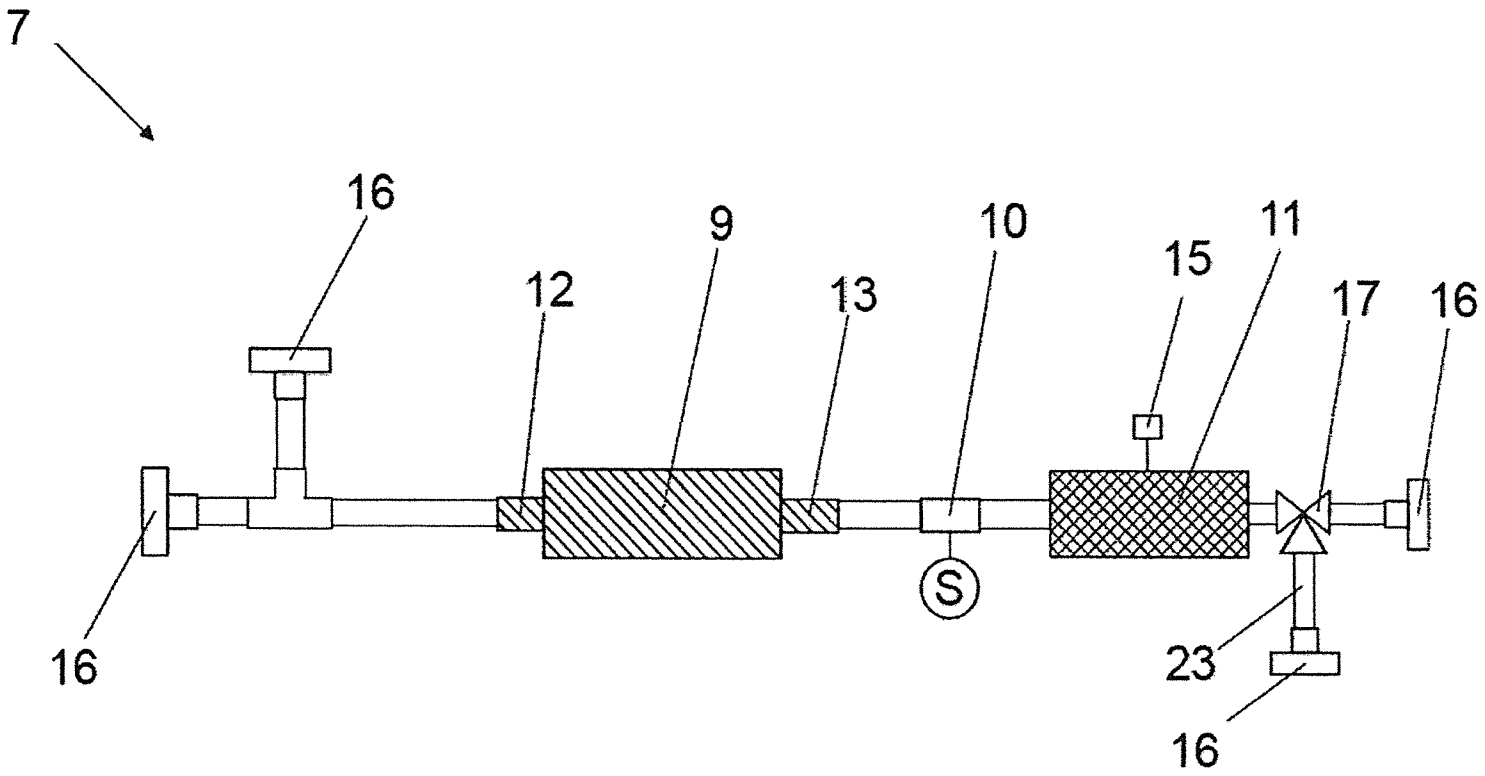
FIG. 7 shows a schematic representation of the mixer, of the sensor device and the sterile filter of FIG. 1, as a prepackaged mixing system.

According to the example of FIGS. 1 and 7, the mixing system 7 is comprised of a static mixer 9, a sensor device 10 that is positioned downstream of the mixer 9 in the direction of flow, and a sterile filter 11 that is positioned downstream of the static mixer 9 in the direction of flow.

The static mixer 9 has a supply line 12 and a discharge line 13. The sensor device 10 is positioned between the static mixer 9 and the sterile filter 11, according to the examples of FIGS. 1 and 7 as well as to the example of FIG. 3. The sensor device 10 may be provided with one or more sensors, not shown. The sensor device 10 may determine individual parameters. The sensor device 10 may, for example, determine the conductance or the pH value. A pressure sensor or a volume sensor may also be provided. The sensor device 10 is connected to the process controller 6 via a signal line 14.

The sterile filter 11 has an RFID tag 15 with a memory, not shown, that may be read by the process controller 6. In the memory of the RFID tag 15 process-relevant data (identity of the filter, release status, compatibility with buffer solutions and test data) may be stored and may be read out, wirelessly, by the process controller 6. The mixing system 7 has, at its attachments known sterile connectors 16 for a sterile connection. The mixing system 7 has a branching valve 17 for discharging discarded solution. The branching valve 17 is connected via a further control line 18 to the process controller 6 and is controlled by the process controller 6.

According to the examples of FIGS. 2 to 6, a third container 19 for a third medium is provided in addition to the first container 2 and the second container 3. Correspondingly, a third pump 20 is positioned upstream of the third container 19, in the direction of flow.

Figure 2:
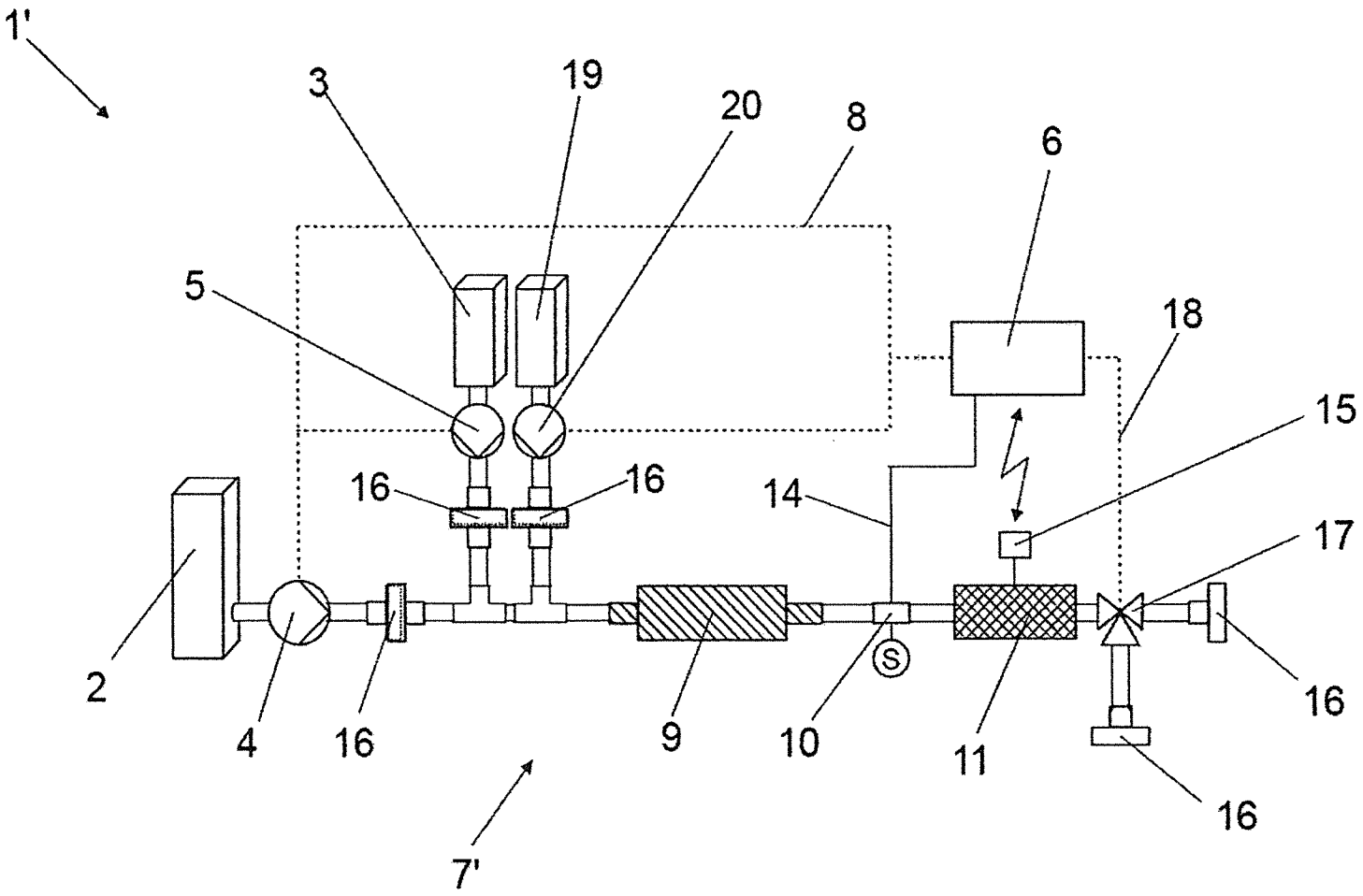
FIG. 2 shows a schematic representation of a device of FIG. 1, which however has a third container for a third medium.
Figure 3:
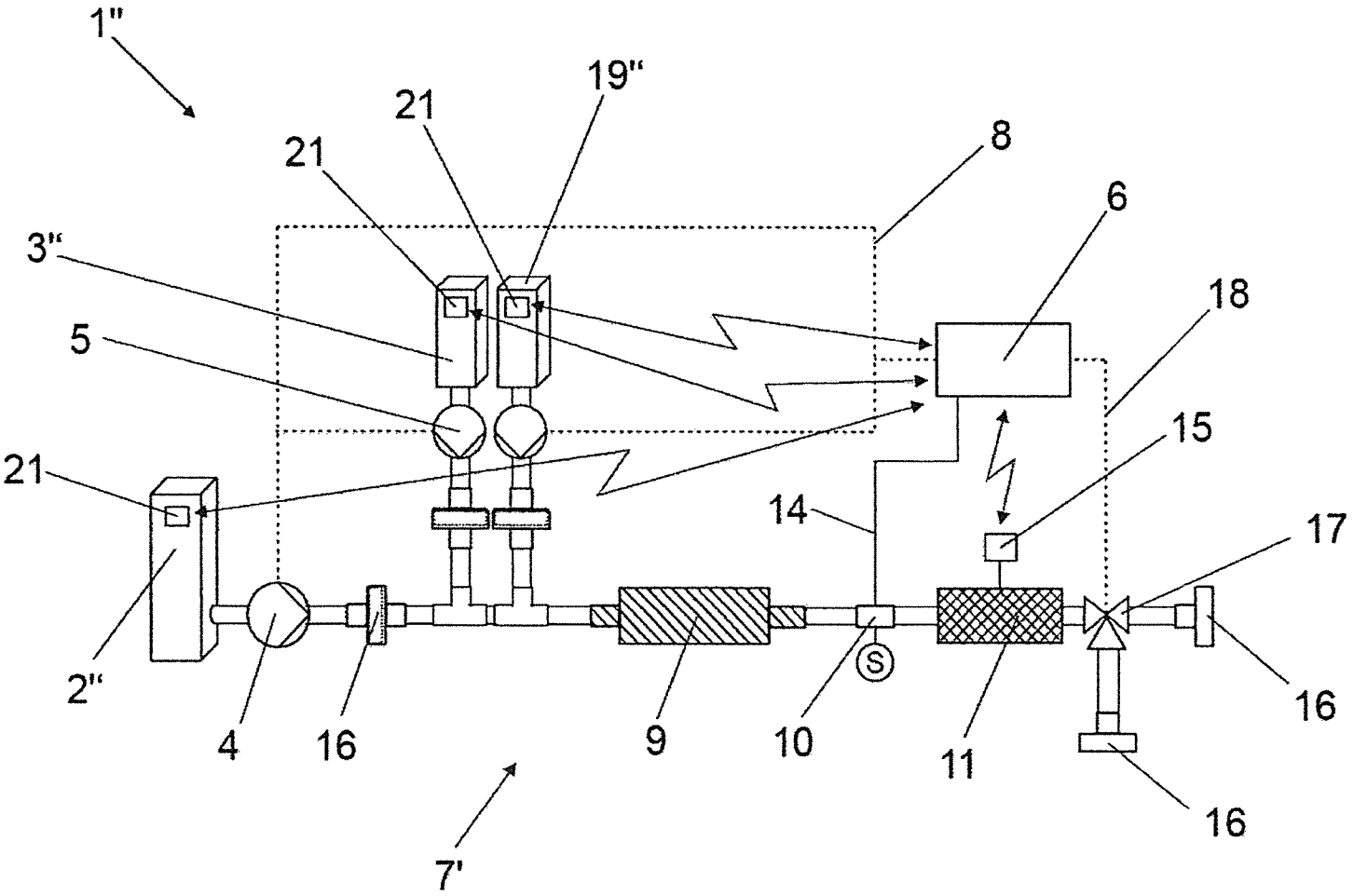
FIG. 3 shows a schematic representation according to FIG. 2, in which the containers each are provided with a RFID tag.

In the example of FIG. 3, the mixing system 7' corresponds to the mixing system 7 of example in FIG. 2. Containers 2", 3" and 19" have RFID tags 21 that may also be read by the process controller 6.

Further process-relevant data referred to containers 2", 3", 19" are stored in the RFID tags 21. In particular it is possible to identify the containers and verify the compatibility and release of their contents.

Figure 4:
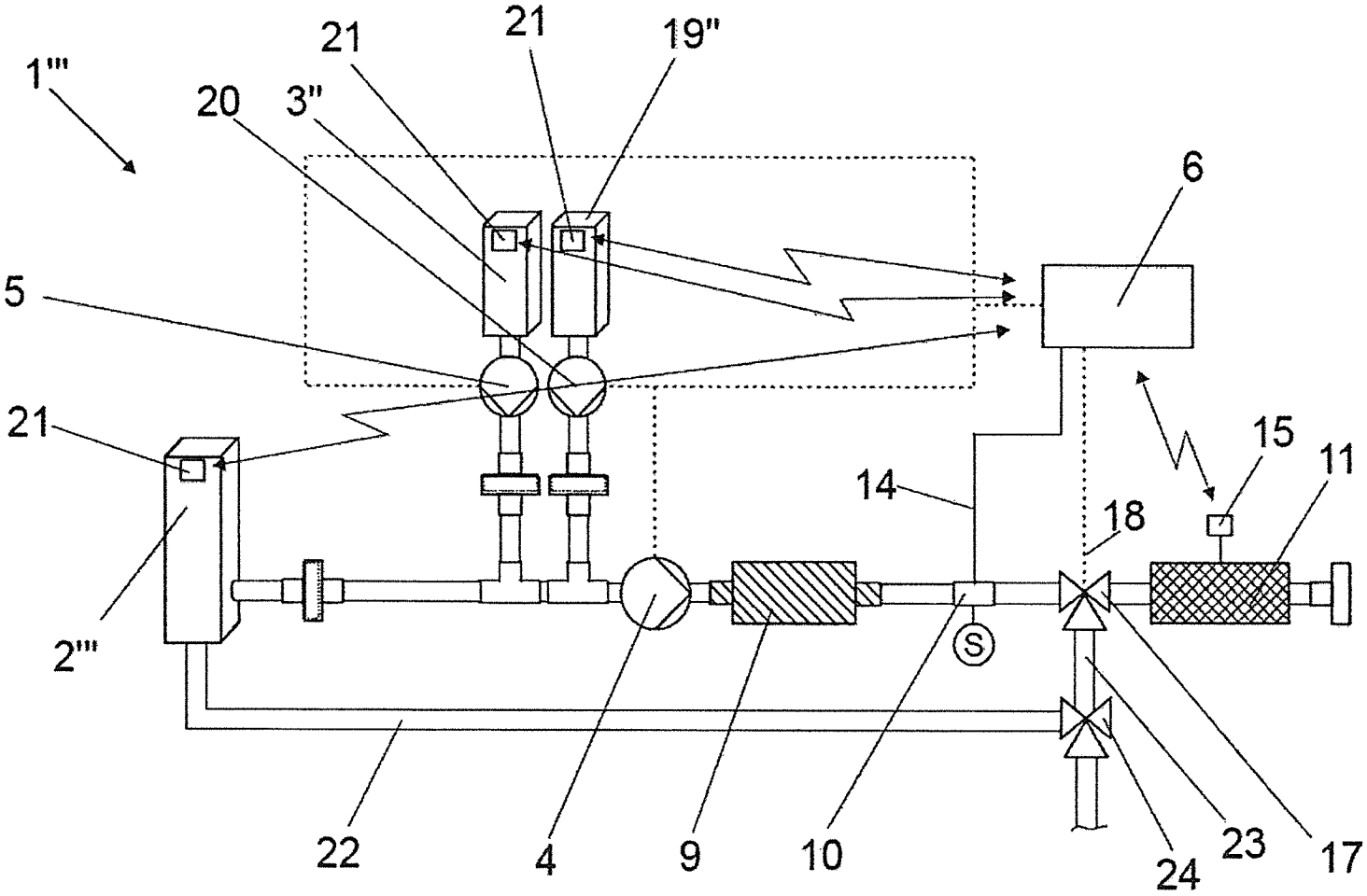
FIG. 4 shows a schematic representation of a further device corresponding to FIG. 3, which however has a second controllable branching valve and a return line to the first container, wherein the first branching valve is positioned between the sensor device and a sterile filter.

In the example of FIG. 4, the device 1''' has a return line 22 that connects the branching line 23 of branching valve 17 via a second branching valve 24 to the container 2'''. According to example of FIG. 4, the branching valve 17 is positioned between the sensor device 10 and the sterile filter 11.

Figure 5:
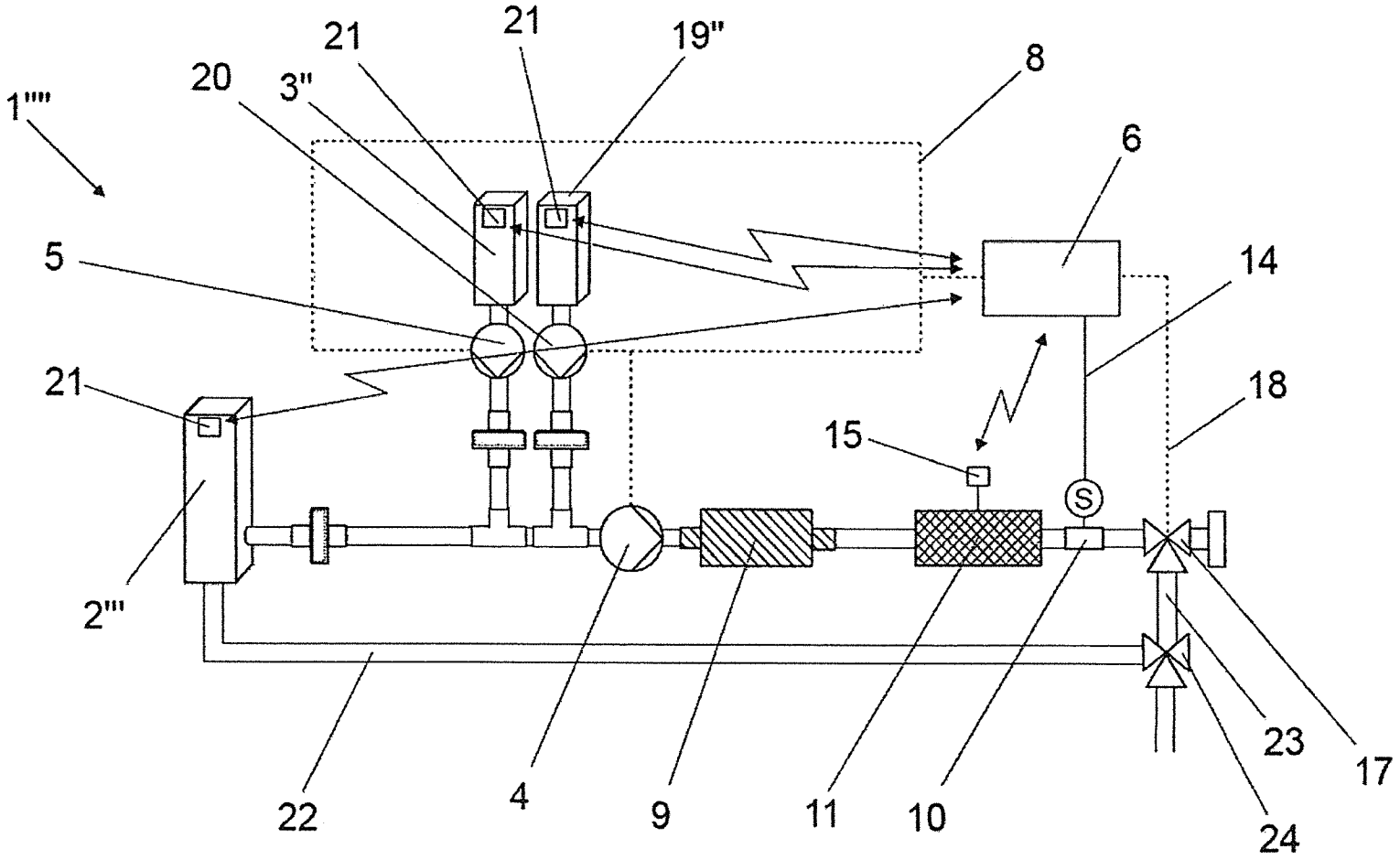
FIG. 5 shows a schematic representation of a further device corresponding to FIG. 4, wherein the sensor device and the branching valve are positioned downstream of the sterile filter in the direction of flow.

The example of device 1''' in FIG. 5 essentially corresponds to the example of FIG. 4, with the exception that the sensor device 10 is now positioned downstream of the sterile filter, in the direction of flow. Correspondingly, the branching valve 17 is positioned downstream of the sensor device 10 in the direction of flow.

Figure 6:
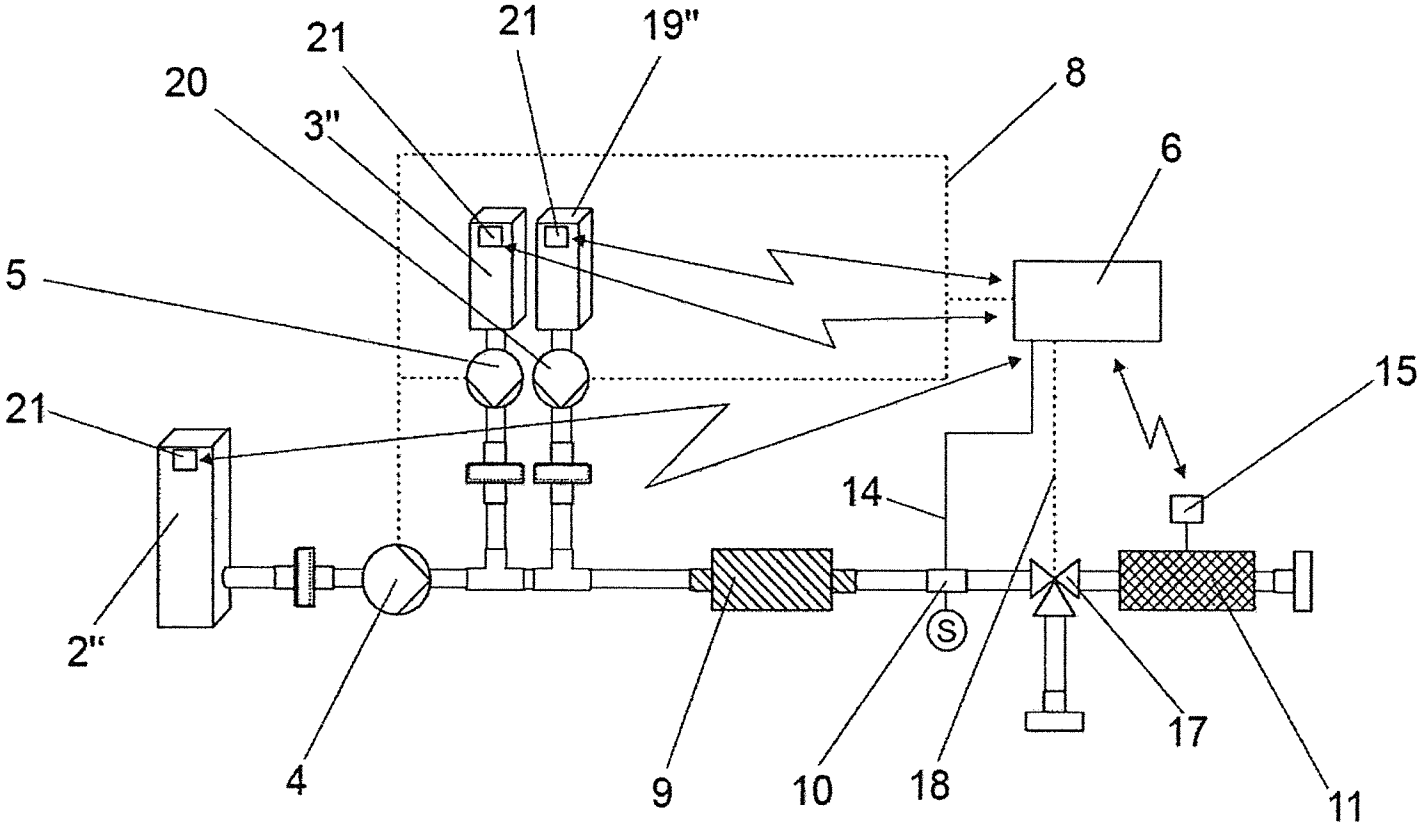
FIG. 6 shows a further schematic representation of a device corresponding to FIG. 3, which however has a branching valve, which is arranged between the sensor device and the sterile filter.

Finally, the example of FIG. 6 essentially corresponds to the example of FIG. 3, with the exception that the branching valve 17 is positioned between the sensor device 10 and the sterile filter 11.

According to the example of FIG. 7, the static mixer 9, the sensor device 10 and the sterile filter 11, having the RFID tag 15, together with the sterile connectors 16 as attachments for connection to the containers 2, 3 or pumps 4, 5 associated to containers 2, 3, form the prepackaged mixing system 7.

It is obvious that the embodiments discussed in the specific description and shown in the figures only represent illustrative embodiments of the present invention. The person skilled in the art is provided with a wide range of possible modifications in view of the present disclosure.

REFERENCE LIST

1, 1', 1", 1''', 1'''' device
2, 2", 2''' first container
3, 3" second container
4 first pump
5 second pump
6 process controller
7, 7' mixing system
8 control lines
9 static mixer of 7
10 sensor device of 7
11 sterile filter of 7
12 supply line of 9
13 discharge line
14 signal line of 10
15 RFID tag of 11
16 sterile connector
17 branching valve
18 control line
19, 19" third container
20 third pump
21 RFID tag of 2", 3", 20"
22 return line
23 branching line of 17
24 second branching valve

The invention claimed is:

1. A device (1") for producing a solution of at least one liquid first medium and at least one second medium, comprising:

a first container (2") for the liquid first medium;

a second container (3") for the second medium;

a first pump (4) for directing the liquid first medium from the first container (2");

a second pump (5) for directing the second medium from the second container (3");

a prepackaged disposable sterile mixing system (7, 7') that comprises:

a static mixer (9) having a supply line (12) that receives the liquid first medium from the first pump (4) and the second medium from the second pump (5), the static mixer (9) being configured to mix the liquid first medium and the second medium to produce a mixed solution;

a sensor device (10) arranged downstream of the static mixer (9) in a flow direction and configured to sense characteristics of the mixed solution flowing from the static mixer (9);

a sterile filter (11) arranged downstream of the static mixer (9) in the flow direction;

an RFID tag (15) associated with the sterile filter (11) and storing process-relevant data; and sterile connectors (16) configured as attachments for connection of the prepackaged disposable sterile mixing system (7, 7') to the containers (2", 3") or to the pumps (4, 5) that are associated to the containers (2''', 3"); and the device (1") further comprising:

a branching valve (17) arranged downstream of the static mixer (9) in the flow direction and configured to direct the mixed solution in either of first and second directions; and a process controller (6) communicating with the RFID tag (15), the sensor device (10), the first pump (4), the second pump (5), and the branching valve (15), the process controller (6) controlling operation of the first pump (4), the second pump (5), and the branching valve (15) based on the process-relevant data stored on the RFID tag (15).

2. The device of claim 1, wherein a third container (19") for a third medium is connected to the supply line of the static mixer (9) via a third pump (4, 5) that can be regulated by the process controller (6).

3. The device of claim 1, wherein the sterile filter (11) further is arranged downstream of the sensor device (10) in the flow direction.

4. The device of claim 3, wherein the branching valve (17) further is arranged downstream of the sterile filter (11) in the flow direction.

5. The device of claim 4, further comprising additional RFID tags (21, 21) associated respectively with the first container (2") and the second container (3"), the additional RFID tags (21, 21) storing process-relevant data and where the process controller (6) controls operation of the first pump (4), the second pump (5), and the branching valve (15) based on the process-relevant data stored on the additional RFID tags (21, 21).

6. The device of claim 1, wherein the branching valve (17) further is arranged downstream of the sterile filter (11) in the flow direction.

7. The device of claim 1, further comprising additional RFID tags (21, 21) associated respectively with the first container (2") and the second container (3"), the additional RFID tags (21, 21) storing process-relevant data, and where the process controller (6) controls operation of the first pump (4), the second pump (5), and the branching valve (15) based on the process-relevant data stored on the additional RFID tags (21, 21).

8. A device (1") for producing a solution of at least one liquid first medium and at least one second medium, comprising:

a first container (2") for the liquid first medium;

a second container (3") for the second medium;

a first pump (4) for directing the liquid first medium from the first container (2");

a second pump (5) for directing the second medium from the second container (3"); and a prepackaged disposable sterile mixing system (7, 7') that comprises:

a static mixer (9) having a supply line (12) that receives the liquid first medium from the first pump (4) and the second medium from the second pump (5), the static mixer (9) being configured to mix the liquid first medium and the second medium to produce a mixed solution;

a sensor device (10) arranged downstream of the static mixer (9) in a flow direction and configured to sense characteristics of the mixed solution flowing from the static mixer (9);

a sterile filter (11) arranged downstream of the static mixer (9) in the flow direction;

an RFID tag (15) associated with the sterile filter (11) and storing process-relevant data;

a branching valve (17) arranged downstream of the static mixer (9) in the flow direction and configured to direct the mixed solution in either of first and second directions; and sterile connectors (16) configured as attachments for connection of the prepackaged disposable sterile mixing system (7, 7') to the containers (2", 3") or to the pumps (4, 5) that are associated to the containers (2'", 3"); and the device (1") further comprising a process controller (6) communicating with at least the first pump (4), the second pump (5), the RFID tag (15), the sensor device (10) and the branching valve (15), the process controller (6) controlling operation of the first pump (4), the second pump (5) and the branching valve (15) of the prepackaged disposable sterile mixing system (7, 7') based on the process-relevant data stored on the RFID tag (15).

9. The device of claim 8, wherein the sterile filter (11) further is arranged downstream of the sensor device (10) in the flow direction.

10. The device of claim 9, wherein the branching valve (17) further is arranged downstream of the sterile filter (11) in the flow direction.

11. The device of claim 10, further comprising additional RFID tags (21, 21) associated respectively with the first container (2") and the second container (3"), the additional RFID tags (21, 21) storing process-relevant data and where the process controller (6) controls operation of the first pump (4), the second pump (5), and the branching valve (15) based on the process-relevant data stored on the additional RFID tags (21, 21).

12. The device of claim 8, wherein the branching valve (17) further is arranged downstream of the sterile filter (11) in the flow direction.

13. The device of claim 8, further comprising additional RFID tags (21, 21) associated respectively with the first container (2") and the second container (3"), the additional RFID tags (21, 21) storing process-relevant data, and where the process controller (6) controls operation of the first pump (4), the second pump (5), and the branching valve (15) based on the process-relevant data stored on the additional RFID tags (21, 21).

* * * * *